US005591304A

United States Patent [19]

Tolan et al.

[11] Patent Number: 5,591,304

[45] Date of Patent: Jan. 7, 1997

[54] METHOD FOR THE USE OF ENZYMES IN BLEACHING PAPER PULP

[75] Inventors: Jeffrey Tolan; Brian Foody, both of Ottawa, Canada

[73] Assignee: Von Kreisler Selting Werner, Cologne, Germany

[21] Appl. No.: 317,828

[22] Filed: Oct. 4, 1994

Related U.S. Application Data

[63] Continuation of Ser. No. 72,861, Jun. 7, 1993, abandoned, which is a continuation of Ser. No. 696,714, May 7, 1991, abandoned.

[51] Int. Cl.[6] ..... D21C 9/10

[52] U.S. Cl. ..... 162/60; 162/65; 162/72; 162/78; 162/82; 162/83; 162/88

[58] Field of Search ..... 162/72, 82, 60, 162/65, 88, 89, 78, 83; 435/277, 778

[56] References Cited

U.S. PATENT DOCUMENTS

| | | | |
|---|---|---|---|
| 4,138,313 | 2/1979 | Hillstrom et al. | 162/60 |

FOREIGN PATENT DOCUMENTS

| | | |
|---|---|---|
| 2019411 | 12/1990 | Canada . |
| 0373107 | 6/1990 | European Pat. Off. . |
| 0383999 | 8/1990 | European Pat. Off. . |
| 0386888 | 9/1990 | European Pat. Off. . |
| 0395792 | 11/1990 | European Pat. Off. . |
| 0408803 | 1/1991 | European Pat. Off. . |
| WO89/08738 | 9/1989 | WIPO . |
| WO91/02839 | 3/1991 | WIPO . |

OTHER PUBLICATIONS

Novo Brochure "Pulpzyme™ HA", Sep. 1989 (162–72).
Chauvet et al "Assistance In Bleaching of Never Dried Pulps By Use of Xylanases, Consequences on Pulp Properties," 4th Int Symp on Wood & Wood Chan., Apr. 1987.
Communications to the Editor, Biotech & Bioeng. vol. 32, pp. 235–239 1988 (62–72), Paice et al.
Trotter, "Biotech in Pulp & Paper Ind.: A Review", Tappi J. Apr. 1990 (162–72).
Noe, J. Wood. Technol., 6(2): 167–184, 1986.
*Proceedings: 74th Annual Meeting of the Canadian Pulp & Paper Assoc.*, Montreal, Canada, pp. A133–136, Jan. 1988.
Cook, Pulp and Paper Canada, 91:8, 1990.
Paice, Biotechnology and Bioengineering, 32:235–239, 1988.
Kantelinen, Kemia–Keemi, 3:228–231, 1988.
Poutanen, Appl. Microbiol. Biotechnol., 23:487–490, 1986.
Viikari, *Biotechnology in the Pulp and Paper Industry*, 3d International Conference, Stockholm, Jun. 16–19, 1986.
Kantelinen, *Tappi Proceedings*, International Pulp Bleaching Conference, Jun. 5–9, 1988.
Dekker, Biotechnology and Bioengineering, vol. XXV: 1127–46, 1983.
Poutanen, J. of Biotechnology, 6:49–60, 1987.
Ghose, Pure & Appl. Chem., 59(2):257–268, 1987.
Viikari, *Proceedings, International Symposium on Wood and Pulping Chemistry*, Apr. 27–30, 1987.
Germgard, Paperi ja Puu, 4: 287–290, 1983.
Joseleau, Svensk Papperstidn, 84: R123, 1981.

(List continued on next page.)

*Primary Examiner*—Steven Alvo
*Attorney, Agent, or Firm*—Fitzpatrick, Cella, Harper & Scinto

[57] ABSTRACT

A method and apparatus for treating wood pulp that includes incompletely washed brownstock, in which the brownstock is treated at a pH range of approximately 7.0 to 9.0 with a hemicellulase enzyme preparation that has a pH optimum below 6.0. Also, a method and apparatus for treating wood pulp containing incompletely washed brownstock in which the brownstock is treated at a pH range of approximately 6.0 to 9.0 with a hemicellulase enzyme preparation that has a pH optimum below 6.0 and that has a low cellulase content such that not more than about 10,000 FPU are added per ton of pulp.

15 Claims, 5 Drawing Sheets

OTHER PUBLICATIONS

Das, Carboh. Res., 129:197–207, 1984.
Conrad, Biotechnol. Lett., 3:345–350, 1981.
Singh, The Bleaching Pulp, Tappi Press, Chapters 3, 4, 6, 1979.
du Manoir, *International Pulp and Bleaching Conference*, "BioBleaching of Kraft Pulps with Cellulase–Free Xylanase", Jun. 1991.
Voest Alpine, Chem. Eng., 98(8), p. 23, Aug. 1991 (Abstract).
Tan, Biotech. and Bioeng., vol. XXX: 96–100, 1987.
McCarthy, J. of Appl. Bact., 66:439–444, 1989.
Yaguchi, 1989 DFBS Abstract/Symposium "Isolation and Characterization of Two Xylanases from Trichoderma Viride", 1989.
Wong, Microbiological Reviews, pp. 305–317, Sep. 1988.
Jeffries, 4th Chemical Congress of North America, New York, NY (note 210), Aug. 1991.
Luthi, Appl. Microbiol. Biotechnol., 36:503–506, 1992.
Royer, J. Biochem., 202:521–529, 1991.
Paice, *Enzyme Microbial Technol.* "Mechanism of Hemicellulose–Directed Pre–bleaching of Kraft Pulps", in press 1992.
International Symposium of Xylans and Xylanases, Wageningen, The Netherlands, abstracts by McCarthy, Yaguchi, Farrell, Rozie, Pembroke, et al., Dec. 1991.
Jeffries, "Biotechnology in Pulp and Paper Manufacture", Chapter 17, May 1989.

ACTIVITY VERSUS pH
TEMPERATURE: 40°C
REACTION TIME: 20 min.

ISOELECTRIC FOCUSING GEL OF NOVO PULPZYME (LEFT) AND IOGEN XYLANASE

METHOD FOR THE USE OF ENZYMES IN BLEACHING PAPER PULP

This application is a continuation of application Ser. No. 08/072,861 filed Jun. 7, 1993, now abandoned, which in turn is a continuation of application Ser. No. 07/696,714, filed May 7, 1991, also now abandoned.

BACKGROUND OF THE INVENTION

1. Field of the Invention

The present invention relates to processes for treating paper pulp and particularly relates to a method for enzyme treatment of paper pulp. One of the biggest challenges facing the pulp and paper industry is to reduce the use of chlorine in the bleaching process. The effluent from the pulp bleaching plant, that portion of a mill that converts brown pulp to white, contains numerous chlorinated organic substances including toxic chlorinated phenols and dioxin. Pulp and paper processors worldwide are under intense regulatory pressure to reduce these emissions.

The present invention relates to an improved method for using enzymes in the processing of paper pulp to boost the efficiency of the bleaching process. The process of this invention overcomes a critical and heretofore unrecognized problem that has reduced the effectiveness of enzymes in a conventional pulp mill bleachery. The invention makes possible a three to four fold improvement in the "brightness boosting" power of these enzymes as well as reduced chlorine requirements.

2. Background of the Invention

The starting point for making paper is wood. Wood consists primarily of cellulose, hemicellulose, and lignin. The manufacture of high quality, bright white paper largely depends on removing the lignin from the wood pulp with minimal degradation to the cellulose and hemicellulose. Although lignin is present in lower grades of paper such as newsprint, complete lignin removal is essential for the production of fine paper. This is because lignin weakens and imparts color onto the pulp. The most common method for producing strong pulp that is light in color for high quality paper is the Kraft process. In North America, for example, 32.8 million tons of bleached Kraft pulp are presently produced annually for paper manufacture.

In conventional Kraft pulping, 80% to 95% of the lignin is removed from the wood by cooking it in an alkali liquor. After being washed with water, the cooked material contains 1.5% to 5% residual lignin and is known as brownstock. The remaining lignin is removed by a multistage bleaching process to obtain a bright, stable final product.

The first two stages of a conventional bleaching process involve treating the brownstock with chlorine, and then extracting the pulp with sodium hydroxide. These chlorine and extraction stages reduce the lignin concentration in the pulp to less than 1% and are known as the "delignification" stages. After delignification, the final remaining lignin in the pulp is removed by treating it with oxidizing chemicals such as chlorine dioxide, sodium hypochlorite and sodium hydrosulphite. These treatment stages are known as the "brightening" stages because the final product is the desired bright white pulp.

Unfortunately, the effluent from this chlorine-based bleaching process contains several classes of toxic compounds, namely organochlorines. These compounds are formed principally when chlorine reacts with lignin in the first bleaching stage. The organochlorine production by Kraft mills has been expressed in two ways: adsorbable organic halides (AOX) and dioxin level.

AOX is a nonspecific measure of the total organochlorine production of a mill, and is generally 1.5 to 8 kg per ton (T) of pulp produced, or 1 to 10 T/day for most mills. Although the link between AOX and toxicity is not clear, there is recent evidence that the $LD_{50}$ for trout is 50 ppm AOX in wastewater (Cook et al., Pulp and Paper Canada 91:8, 1990). Dioxin is a specific compound that accounts for about 1/1000 of the AOX. Dioxin is one of the most acutely toxic compounds known, and has been found in mill effluents, in the pulp itself, in finished pulp products (coffee filters, milk cartons, diapers, writing paper), and in the food chain (including trout and crab) where dioxin bioaccumulates to levels thousands of times higher than in pulp wastewater.

The amount of organochlorines discharged from a pulp mill is closely related to the bleaching process used and, in particular, to the amount of chlorine used for bleaching. The following relationship between AOX production and bleaching chemical usage has been recognized:

$$AOX=0.12(C+H/2+D/5) \quad (1)$$

where the AOX discharge is expressed in kg/T pulp, C is the chlorine charge (kg/T pulp), H is the hypochlorite charge (kg active chlorine/T pulp) and D is the chlorine dioxide charge (kg active chlorine/T pulp) (Germgard et al., Paperi ja Puu, 4: 287–290, 1983).

Some of the present technologies recognized to reduce chlorine usage include:

1. Extended delignification. This method involves prolonging the kraft pulping process to enhance lignin removal before bleaching. The lignin content of softwood brownstock is thereby reduced from 4% to 3%, which in turn reduces chlorine levels and AOX discharges by 20%. Extended delignification techniques involve additional digester capacity, which is prohibitively expensive for existing mills. This option is only appropriate for new mills.
2. Oxygen delignification. The use of oxygen gas to treat the pulp before the C stage can reduce the lignin content of softwood brownstock from 4% to 2%, thereby reducing AOX discharges by up to 50%. Oxygen delignification, however, is an extremely capital intensive operation, costing as much as $20 to $50 million.
3. High chlorine dioxide substitution. The substitution of chlorine dioxide for chlorine in the C stage can reduce the AOX discharge by up to 50%. The capital cost of installing chlorine dioxide generators, however can be over $10 million for mills without the existing equipment. The high cost of chlorine dioxide could be expected to add $12/T or more of bleaching chemical cost at 100% substitution for chlorine.

Clearly, these alternatives incur significant costs. One of the primary objectives of this invention is to provide an improved way of using enzymes as part of the bleaching process to make it practical to reduce AOX discharges without incurring significant capital expenses.

Enzymes are biological catalysts, i.e., they are proteins with molecular weights ranging from 12,000 to 200,000 daltons that accelerate specific chemical reactions without being consumed in the overall process. They typically work in aqueous media, at atmospheric pressure, and at mild temperatures ranging 20° C. to 60° C.

Enzymatic catalysis involves the formation of an intermediate complex between the enzyme and its substrate. The region of an enzyme that specifically interacts with the substrate is called the active site. On binding to this site, the substrate is brought into close proximity to specific groups on the enzyme that cooperatively destabilize certain bonds in the substrate, making them more chemically reactive.

Enzymes differ most strikingly from ordinary chemical catalysts in their substrate specificity and catalytic efficiency. Most enzymes have only a few natural substrates, which are converted to single products in remarkably high yields. The unique structures of the active sites of enzymes provide this specificity and not only allow favorable binding of specific substrates but also exclude the unfavorable binding of many substances that are not substrates. There are strong attractive non-covalent forces between the active site and a substrate, and enzymes may be thought to act by "attracting" the substrate into the site, where the extraordinarily unique structural transformations of the substrate occur. For enzyme systems, a high degree of specificity is maintained, with the reaction proceeding $10^6$ to $10^{12}$ times faster than the spontaneous, uncatalyzed reaction in aqueous solution.

The pH has a marked influence on the rate of enzymatic reactions. Characteristically, for each enzyme there is a pH value at which the rate of reaction is optimal, and on each side of this optimum, the rate is lower. The influence of pH on enzymatic reactions may involve several different types of effects. Enzymes, like other proteins, are ampholytes and possess many ionic groups. If enzymatic function depends on certain special groupings, these may have to be present in some instances in the un-ionized state and, in others, as ions. In some cases, the groups in the active site of the enzyme that are responsible for catalytic action have even been identified by comparing the effect of pH on enzymatic activity and the known pK values of titratable groups in the protein. The pH may also influence the rate of enzymatic reaction indirectly insofar as many enzymes, like proteins in general, are stable only within a relatively limited pH range.

The use of enzymes to reduce chlorine requirements in pulp bleaching has been known and involves the treatment of brownstock with a class of enzymes, known as hemicellulases, that hydrolyze the hemicellulose portion of wood pulp. Hemicellulose in wood pulp consists of two types of structures with polysaccharide backbones: xylan and glucomannan. Xylan, which forms 90% of the hemicellulose in hardwood and 50% of that in softwood, is substituted with arabinosyl, acetyl, and other side groups. Glucomannan is found primarily in softwood. The enzymes that have shown benefit in bleaching include xylanase, arabinase and mannanase (Paice, et al., Biotechnology and Bioengineering, 32:235–239, 1988; Viikari, et al., Biotechnology in the Pulp and Paper Industry, The 3rd International Conference, Stockholm Jun. 16–19, 1986; Preliminary Product Information, Pulpzym™ Novo Enzyme Process Division, 1989; Kantelinen et al. International Pulp Bleaching Conference, Jun. 5–9 1988, TAPPI Proceedings pp. 1–9); i.e., enzymes that hydrolyze xylan, araban, and mannan linkages. Each of these enzymes catalyze a specific and known chemical reaction, hydrolysis. It is therefore generally believed that enzymes enhance the extractability of lignin by partially hydrolyzing the hemicellulose portion of unbleached pulp. This, in turn, leads to a significantly reduced chlorine requirement to bleach pulp.

In this regard, studies have reported linkages between hemicellulose, particularly xylan, and lignin (in wood) (Eriksson, et al., Wood Sci. Technol. 14:267–279 1980). The two types of linkages that have been shown are ester linkages between ligninand the methylglucuronic acid residues of xylan (Das, et al., Carboh. Res. 129: 197–207, 1984), and ether bonds from lignin to hydroxyl moieties of the arabinosyl side groups of xylan (Joseleau et al., Svensk Papperstidn, 84: R123, 1981). It has been hypothesized that by hydrolyzing hemicellulose, these enzymes act to "release" lignin from chemical linkages to the fiber being bleached.

A number of microorganisms are known to make hemicellulase enzymes. Xylanolytic enzymes (xylan attacking enzymes including xylanase and arabinase) are produced by microorganisms including *Trichoderma reesei, Aspergillus awamori, Streptomyces olivochromogenes,* and *Fusarium oxysporum* (Poutanen, et al., Appl. Microbiol. Biotechnol. 23:487–490, 1986; Poutanen, et al., J. of Biotechnology, 6:49–60, 1987; European Patent Application 0373107, filed published Jun. 13, 1990). Mannanase enzymes are made by Trichoderma and Aspergillus sp., among others (Kantelinen, Kemia-Keemi 3: 228–231), 1988). This invention is particularly concerned with the use of so-called "acid" hemicellulase enzymes, i.e., enzymes whose optimum activity is at pH levels ranging from 3 to 6.

The use of hemicellulases to enhance the bleaching of pulp has been reported by researchers at VTT in Finland, the Pulp and Paper Research Institute in Canada, and Novo in Denmark. In these studies, unbleached pulp was treated with enzymes before the addition of the bleaching chemicals. Enhanced bleaching by enzymes is quantified by the increased brightness of enzyme-treated pulp (after bleaching) relative to pulp bleached without enzyme treatment. Brightness is measured by a standard brightness meter and expressed on the ISO scale. A highly reflective barium sulfate surface for example, is 99 ISO brightness, fine writing paper about 90 ISO brightness, and newspaper 65 ISO brightness.

VTT reported that treatment of pulp with hemicellulases from *Aspergillus awamori* and *Streptomyces olivochromogenes* increased the brightness of the pulp after bleaching by up to 5 ISO points (Viikari, et al., Biotechnology in the Pulp and Paper Industry, The 3rd International Conference, Stockholm June 16–19, 1986; Viikari, et al., 1987; Kantelinen, International Pulp Bleaching Conference, Jun. 5–9 1988, TAPPI Proceedings pp. 1–9). This corresponded to a 25% decrease in the amount of chlorine required to reach a given ISO brightness. Both of these hemicellulases were classified as xylanases, because xylanase was putatively the active enzyme that enhanced bleaching. VTT also showed enhanced bleaching with xylanase from *Aspergillus niger* and *Trichoderma reesei* and from *Bacillus subtilis* and arabinase from *Trichoderma reesei* (Kantelinen, International Pulp Bleaching Conference, Jun. 5–9 1988, TAPPI Proceedings pp. 1–9).

Paice, et al., Biotechnology and Bioengineering, 32:235–239, 1988, at Paprican showed that treating unbleached pulp with xylanase enzyme from *Schizophyllium commune* increased the brightness of the pulp (after bleaching) by 7 ISO points.

All of these studies carried out the enzyme treatment of pulp at pH 5, which is recognized as the optimum for the activity of these enzymes. The optimum pH for the xylanase enzymes is determined by isolating the substrate for the enzyme, in this case xylan, and measuring the ability of the enzyme to hydrolyze it in a dilute buffer solution. The term "pH optimum" is used to mean the pH at which a hemicellulase enzyme has optimum activity for the hydrolysis of its natural hemicellulase substrate in a dilute buffer solution. For example, the optimum pH for *T. reesei* xylanase is 4 to 5 and is measured by its ability to hydrolyze xylan (Dekker, Biotechnology and Bioengineering, Vol. XXV:1127–1146, 1983; Poutanen, et al., J. of Biotechnology 6:49–60, 1987; Preliminary Product Information, Pulpzyme™, Novo Enzyme Process Division, 1989). For *A. awamori* xylanase, the pH optimum is 5.0 (Poutanen, et al., J. of Biotechnology 6:49–60, 1987), for *A. niger* xylanase, the pH optimum is 4 to 5 (Conrad, Biotechnol. Lett. 3:345–350, 1981), and for *S. olivochromogenes* xylanase, the pH optimum is 6.0 to 6.5 (Poutanen, et al., J. of Biotechnology 6:49–60, 1987). The procedure of Ebringerova, et al., Holzforschung 21:74–77, 1967, has, for example, been used to isolate xylan from birch, beech, larchwood, and other sources while minimizing changes to the xylan structure. The isolated xylan is therefore of similar structure to the indigenous xylan in wood pulp. All of the enzyme treatments by VTT and Paice, et al. were carried out at pH 5 to be in the range of optimum activity for the xylanase enzymes.

Novo-Nordisk has described the effect of pH on the activity of its enzyme preparation, Pulpzyme™ HA. Pulpzyme™ HA is a xylanase preparation derived from a selected strain of *Trichoderma reesei* in which the enzyme preparation has endo-1,4-beta-D-xylanase, and exo-1,4-beta-D-xylanase activities, and a certain amount of cellulase activity. Pulpzyme™ HA is described by Novo as having been standardized to 500 XYU/g, with one xylanase unit (XYU) defined as the amount of enzyme, under standard conditions of pH 3.8, 30° C., 20 minute incubation, that degrades larchwood xylan to reduce carbohydrates with a reducing power corresponding to 1 μmol xylose. Pulpzyme™ HA further contains approximately 300 EGU/g, in which one endo-glucanase unit (EGU) is the amount of enzyme, under standard conditions of pH 6.0, 40° C., 30 minute incubation, that lowers the viscosity of a carboxymethyl cellulose solution to the same level as an enzyme standard defining 1 EGU. For the NOVO Pulpzyme™ HA, the optimum pH for its performance is pH 4 to 5, and the activity at pH 7 is only 40% of the optimum. Because Kraft brownstock usually has a pH in excess of 9, Novo suggests that the pH of the pulp be adjusted to 5 to 6 for xylanase treatment.

Pulpzyme™ HA contains significant amounts of cellulose degrading activity, in addition to its xylanase activity. This cellulase enzyme can have very undesirable effects on pulp qualities such as pulp strength. As FIG. 1 shows, however, this problem with Pulpzyme™ HA can be slightly ameliorated by recognizing that the potency of xylanase increases relative to cellulase as the pH is increased from 5.5 up to 6.5. By selecting process conditions such as pH 6.5, therefore, Novo suggests that the undesirable effects of cellulase can be reduced. Operating at an elevated pH, however, is done at the expense of a significant reduction in the brightness boosting of the xylanase. Novo teaches that this compromise pH 6.5 level must not be exceeded because "the enzyme is rapidly inactivated above pH 7–8". (Preliminary Product Information, Pulpzyme™ Novo Enzyme Process Division, 1989, at page 3).

In the present invention, a high level of brightness boosting activity is achieved at pH levels previously taught by Novo to inactivate the enzymes. Moreover, in one preferred embodiment, this invention comprises the use of enzyme preparations with low contaminating cellulase levels, i.e., much lower than Pulpzyme™ HA. Accordingly, the Novo teachings of ways to deal with contaminating cellulase are therefore irrelevant to this embodiment.

The pH optima for enhancing bleaching with xylanase of around 5.0 taught by Novo and other workers has been confirmed by our own testing using Kraft brownstock that has been well washed with water. FIG. 2 (from our Example 4) compares the activity profile taught by Novo with the brightness boosting performance of a *Trichoderma xylanase.* As one would expect, the performance of xylanase to brighten pulp drops off significantly as the pH of the pulp is increased, to the point where less than 40% of the maximum brightness boosting is achieved at pH levels over 7.0.

The prior teachings for using enzyme preparations that are substantially free of contaminating cellulase activity in bleaching are absolutely clear on one significant point. They teach that the operating pH should be in the range of 5 to 6 and preferably as close as possible to that of the enzyme's pH optima for hydrolysis.

While the laboratory testing by Novo Nordisk and that shown in FIG. 2 has been conducted with well washed brownstock, most brownstock in commercial mills is not well washed. Operating pulp mills must make compromises between the costs and benefits of washing. As a result, one would typically expect to find significant levels of residual Kraft black liquor in the pulp being sent to the pulp bleachery of an operating mill. The degree of washing is usually assessed by measuring the residual soda in the pulp. While the well washed samples of brownstock used in our laboratory testing had residual soda levels below 1 Kg per ton, one often finds residual soda levels ten times this high in operating mills.

Not surprisingly, residual black liquor is deleterious to the action of xylanase enzymes. The inventors have found, for example, that the conventional treatment conditions used to obtain a peak brightness boost of 7.5 ISO points achieves only a 1 to 2 ISO point brightness boost when applied to brownstock taken directly from the last washing stage of an operating kraft mill, i.e., imperfectly washed material.

BRIEF SUMMARY OF THE INVENTION

The present invention relates to processes for treating paper pulp and particularly relates to an improved method for treating paper pulp with hemicellulase enzymes to enhance the bleaching of Kraft pulp. The invention comprises means for treating Kraft brownstock with hemicellulase enzymes and then bleaching the brownstock using a conventional bleaching sequence.

It is a primary objective of this invention to provide a means to overcome the deleterious effect of Kraft black liquor on enzyme processes for pulp bleaching. This invention teaches a method and related apparatus to almost completely eliminate these deleterious effects, which would otherwise reduce brightness boosting power by 80%. The present inventors have discovered that incompletely or partially washed brownstock can be efficiently delignified with hemicellulase enzymes having a pH optima for activity below 6.0 at a higher pH than expected, thereby eliminating the need to add excessive amounts of acid to the brownstock to achieve the lower optimum pH. Applicants have further discovered that enzyme preparations with a pH optima for hydrolysis of below 6.0 that are substantially free of contaminating cellulase activity are particularly advantageous in brightness boosting.

The present inventors have discovered that, contrary to all expectations, in the Kraft brownstock that has not been fully washed, and contains residual dilute black liquor (i.e., where bound soda>1 Kg/ton), the dilute black liquor enhances the performance of xylanase enzyme at high pH. This is the complete opposite of what it does at the normally preferred conditions of operation for enzyme treatment. In fact, it has such a strongly positive impact that it almost completely, and unexpectedly, cancels out the well known negative effects of increasing pH beyond the optimum level of performance for the enzymes.

As a result, the preferred pH for enzyme treatment is significantly higher than the enzyme's optimum pH for hydrolysis. In fact, the preferred optimum is in a range normally believed to lead to rapid enzyme inactivation. The inventors have found, for example that bleaching results using *Trichoderma xylanase* are three times better at pH 7.0, a range taught by Novo to lead to rapid and complete enzyme inactivation, than at pH 5.0, the putative optimum for enzyme activity and the conventional pH level used previously.

It is very surprising that the enzyme works better at a pH significantly higher than its pH optimum in a system containing black liquor. Even more surprising is that, while the black liquor appears to inhibit enzyme action at optimum pH, it enhances enzyme performance at elevated pH. To our knowledge, this result is completely unexpected and no other enzyme system demonstrates these properties. We can only speculate that several complex factors are working together to cause this effect. For example, at high pH levels, a component in the black liquor may stabilize the enzyme and modify the properties of the substrate, thereby making it more susceptible to attack. It might further be speculated that a change in pH modulates this process by affecting the charge on some acid substituent groups in the black liquor or on the xylan substrate that have a pKa in the range of 5 to 7.

The present inventors have further discovered that dilute or weak black liquor, which might previously have been expected to be harmful to enzyme action, can be used as a buffer solution and mixed with acid and enzyme for simultaneous addition to the brownstock. This eliminates the need for expensive buffer solutions at this stage of processing while allowing optimal hemicellulase activity.

A further objective of this invention, therefore is to obtain an improved means of using acid hemicellulases, i.e., enzymes such as *Trichoderma xylanase* that have an optimum pH for hydrolysis of less than 6.0. It has previously been found that these enzymes do not work well on the partially washed brownstock that is typical of commercial Kraft pulp mills. Another objective is to overcome the inhibition of enzyme activity that is observed in the presence of dilute Kraft black liquor.

The present invention makes possible a three to four fold improvement in the "brightness boosting" power of the enzymes, to produce strong pulp that is light in color. Therefore yet another object of the present invention is to provide an improved process for making paper that uses the bleached pulp of the novel enzyme process, including apparatus for performing the improved process.

DESCRIPTION OF THE PREFERRED EMBODIMENTS

While the brownstock contemplated herein should be at least partially washed, this invention is particularly concerned with providing an effective means for treating incompletely washed pulps, as for example pulps that still have a residual soda level of 1 Kg per ton or greater. Preferably, the incompletely washed pulps should have a residual soda in pulp of between 1 and 50 kg per ton of pulp.

For effective enzyme treatment, the pH of the pulp should be reduced to below at least 9.0 by adding an acid or buffer solution to the brownstock slurry either before or at roughly the same time as when the enzyme is added. The amount of acid/buffer solution that is added should be chosen so as to bring the pH level at which the pulp slurry stabilizes to roughly 6.5 to 8.5. The enzyme treatment should preferably last at least 30 minutes.

Figure 3:
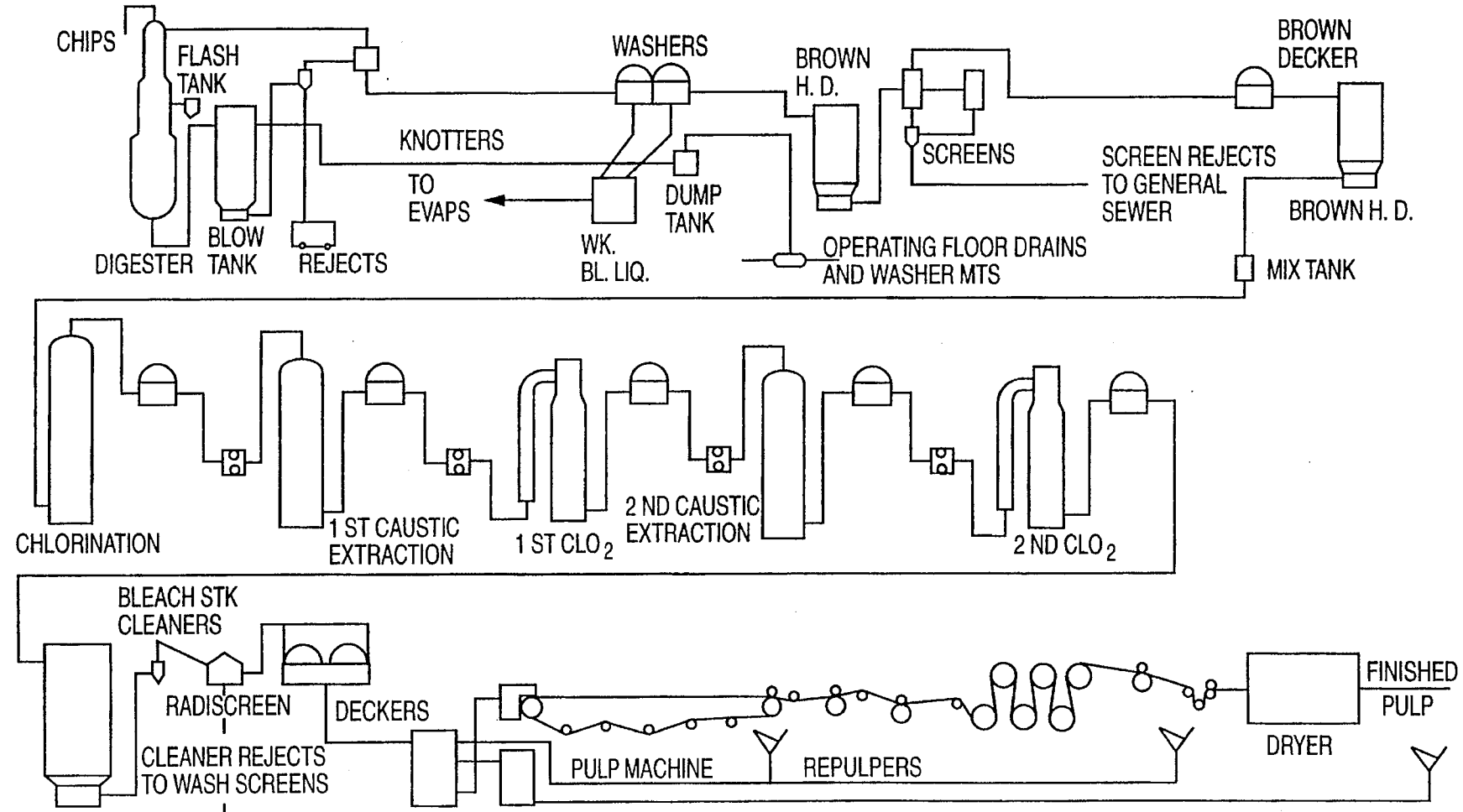
FIG. 3 illustrates the steps in a typical bleaching process.

Referring to FIG. 3, a typical process for producing bleached kraft pulp operates as follows. Wood chips are debarked and then fed into a digester where they are cooked in a concentrated solution of sodium hydroxide and sodium sulfide. The purpose of this process, known as kraft pulping, is to separate the wood chips into individual fibers and to substantially dissolve the lignin portion of the wood. After the cooking is completed, the resulting slurry of fibers, dissolved lignin, and pulping chemicals is blown from the digesters into a blow tank. Knots and incompletely cooked chips are removed from the pulp slurry in specialized machines called knotters. At this point, the fibers are in a solution of dissolved lignin and pulping chemicals, called dilute or weak black liquor. In the next unit operation, a series of rotary drum filters are used to wash the bulk of the weak black liquor away from the fibers. The partially washed fiber, or brownstock, is then stored in a high density brownstock tank, screened, washed again, and then pumped into a storage tank to await bleaching.

The bleaching process may involve anywhere from one to thirteen stages. The specific process described in FIG. 3 consists of a chlorination stage ($C_D$), which uses a combination of chlorine ($Cl_2$) and chlorine dioxide ($ClO_2$) to solubilize most of the residual lignin through substitution and addition reactions onto the lignin aromatic ring. The chlorinated pulp is then washed before entering the alkaline extraction stage (E). Sodium hydroxide is added to the pulp to remove the residual reaction products that were not solubilized in the acidic chlorination stage but readily dissolve in an alkaline medium. The extracted pulp is then washed with water to remove residual caustic. The C and E bleaching stages reduce the lignin content of the pulp to less than 0.5%. The delignified pulp, however, still has an unacceptable dull tan color that requires further processing to reach an acceptable "brightness".

The process outlined in FIG. 3 for the final brightening of the pulp involves a chlorine dioxide (D) treatment stage, followed by a washing and another sodium hydroxide treatment (E), and finally a last chlorine dioxide (D) stage. The entire bleaching process is described as a $C_D$EDED sequence.

In the process of the present invention, an acid or buffer solution is added to the brownstock at a point after the first stage of brownstock washing but before the last brownstock storage tank. This is intended to reduce the pH of the brownstock slurry to below 9.0. A hemicellulase enzyme preparation should be added to the brownstock slurry at roughly the same time or somewhat after the acid/buffer addition. The brownstock slurry should be mixed, for example with a mixing pump, to ensure uniform distribution of enzyme and then held in a storage tank or line for a period of at least 15 minutes, and preferably at least 1.0 hour. The amount of acid/buffer solution that is added should be chosen so that the pH level at which the pulp slurry stabilizes during the enzyme treatment is between at least 6.5 to 8.5.

The brownstock may be either softwood or hardwood and should have a residual soda level between about 1 and 50 kg/ton. The preferred range of pulp kappa numbers is between 20 and 40 for softwood and 10 to 20 for hardwood, however, the process of this invention can be applied to oxygen delignified pulps with even lower kappa numbers.

The enzymes added should be from the class of hemicellulose degrading enzymes that have a pH optimum for hydrolysis between 3.0 and 6.0. They may include, but are not limited to: xylanase, endo-xylanase, beta-xylosidase, mannanase, and arabinase. This invention preferably concerns the use of xylanase or other hemicellulase enzymes that have pH optima for hydrolysis of below 6.0 and are substantially free of contaminating cellulase activity. In this preferred embodiment, the invention relates to enzyme preparations wherein the total cellulase activity added to the pulp is not more than about 10,000 filter paper units (FPU) of cellulase per ton of pulp using the IEA standard filter paper assay (see Example 2). This feature can be contrasted with Pulpzyme™ HA, wherein the recommended 0.17% dosage (as described in Preliminary Product Information, Pulpzyme™ Novo Enzyme Process Division, 1989, at page 1), results in an addition of about 70,000 FPU per ton. Measurement of the cellulase and xylanase activities is described in Examples 1 and 2.

The acid used for pH adjustment may include sulphuric, sulfurous, hydrochloric, phosphoric or any other appropriate acid. These acids may be buffered so as to reduce extremes of pH. When the acid/buffer solution is added to the brownstock slurry it should reduce the pH to below 9.0. In some instances, the pulp slurry may be so thick that it will take as long as 60 minutes for the pH of the free liquid in the pulp to stabilize. The amount of acid/buffer solution added to the brownstock should be chosen so that the pH level at which the pulp slurry stabilizes is between 6.0 and 9.0, and more preferably between 6.5 and 8.5. The pH should be at least 1 point higher than the apparent pH optimum for the enzyme when it is hydrolyzing its target substrate. In one embodiment of this invention, the process is carried out using a xylanase enzyme preparation produced by the fungus *Trichoderma reesei. T reesei* also produces a group of cellulase and hemicellulase enzymes. It is preferred in the practice of this invention that the specific cellulase content of the enzyme preparation contemplated be very low so that not more than about 10,000 FPU of cellulase activity is added per ton of pulp (see Examples 1 and 2), and more preferably about 2,000 FPU or even about 500 FPU or less per ton of pulp. By contrast, the Novo product Pulpzyme™ HA has an apparent cellulase content that is unacceptably high for this embodiment.

In a further embodiment of this invention, as it may be applied to a mill with a flow sheet as outlined in FIG. 3, sulphuric acid solution may be sprayed onto the pulp as it comes off the brownstock decker. The amount of acid should be chosen so that the pH of the brownstock slurry will stabilize at roughly 7.0. After the acid has been sprayed onto the pulp a xylanase enzyme made by *T. reesei* should be added to the brownstock just prior to its entering a mixing pump and being pumped into the last major brownstock storage tank. The pulp should have a residence time of preferably over one hour in this brownstock storage tank.

A further embodiment of this invention, as it may be applied to a mill with a flow sheet as outlined in FIG. 3, is to recycle some of the weak black liquor solution, which heretofore had been believed to be deleterious to the enzyme, and spray it, in combination with a sulphuric acid solution, onto the pulp as it comes off the brownstock decker. The amount of acid should be chosen so that the pH of the brownstock slurry will stabilize at roughly 7.0. After the weak black liquor has been sprayed onto the pulp, a xylanase enzyme made by *T. reesei* should be added to the brownstock just prior to its entering a mixing pump and being pumped into the last major brownstock storage tank. Alternatively, the enzyme may be included in the spray going onto the pulp with the black liquor and the sulfuric acid. The amount of sulfuric acid to be added would be chosen using feedback control techniques to adjust the pH at which the brownstock slurry will stabilize to between 6.0 and 9.0. The pulp should have a residence time of preferably over one hour in this brownstock storage tank.

EXAMPLE 1

Measurement of Xylanase Activity

The xylanase activity of two xylanase enzyme samples, Novo Pulpzym™ HA and a preparation of xylanase prepared by Iogen Corporation was measured as follows.

A xylan substrate was made using oat spelt xylan from the Sigma Chemical Co. (Catalog X0627) in the following manner. An aqueous suspension of 2 g xylan was prepared in 100 ml deionized water and stirred at 50° C. for 1 hour. The suspension was vacuum-filtered and the filter cake was washed with 100 ml deionized water to remove all the soluble xylan. The insoluble portion was then resuspended in 70 ml of deionized water and uniformly distributed by gentle mixing. A further dilution was made with citrate buffer to adjust the solids content of the suspension to 1%.

0.5 ml samples of the xylan suspension were then heated to 50° C., mixed with varying amounts of enzyme that was diluted into 0.5 ml of citrate buffer also at 50° C., and held for 30 minutes.

The reaction was then stopped by adding 0.5 ml of a solution containing 10 g/l $Na_2HPO_4$ mg and 7.5 g/l of NaOH. The resulting samples were then centrifuged to remove insoluble substrate and assayed for the total amount of reducing sugar (as xylose) released in the reaction using the DNS method. The activity of the enzyme was calculated based upon the amount of enzyme that is needed to produce 0.50 mg of xylose in the assay. These results are shown in Table 1.

TABLE 1

| | Pulpzyme ™ HA | Iogen Xylanase |
|---|---|---|
| Volume of Enzyme that Produces 0.5 mg | 0.171 μl | 0.081 μl |
| Activity of Enzyme | 650 XU/ml | 1370 XU/ml |

EXAMPLE 2

Measurement of Cellulase Activity

The cellulase activity of two *Trichoderma xylanase* enzyme samples, Novo Pulpzyme™ HA and a preparation of xylanase, prepared by Applicants and available from Iogen Corporation, with common enzyme characteristics to the Novo preparation but with a reduced cellulase content, was measured by the IEA standard filter paper assay (Ghose, Pure & Appl. Chem., 59: 257–268, 1987). The activity was calculated by determining the μl of enzyme required to produce 2.0 mg of glucose in the assay. The results are shown in Table 2.

From the results shown in Examples 1 and 2, the relative cellulase and xylanase activity for Applicants' Iogen xylanase preparation is 15.21 IU/ml: 1370 XU/ml=1.11%. The relative cellulase activity for the Pulpzyme™ HA is 39.9 IU/ml: 650 XU/ml=6.13%. Cellulase activity added per ton of pulp was calculated based on the relative cellulase activity of the enzyme preparation, as shown in Table 2.

TABLE 2

| | Pulpzyme ™ HA | Iogen Xylanase |
|---|---|---|
| Volume of Enzyme to Produce 2.0 mg | 4.6 μl | 12.1 μl |
| Activity of Enzyme | 39.9 FPU/ml | 15.21 FPU/ml |
| Typical Addition Rate | 0.17% | 0.065% |
| Cellulase Addition Rate | 70,000 FPU/ton (approximately) | 10,000 FPU/ton (approximately) |

EXAMPLE 3

Localization of Xylanase Enzyme

Figure 4:
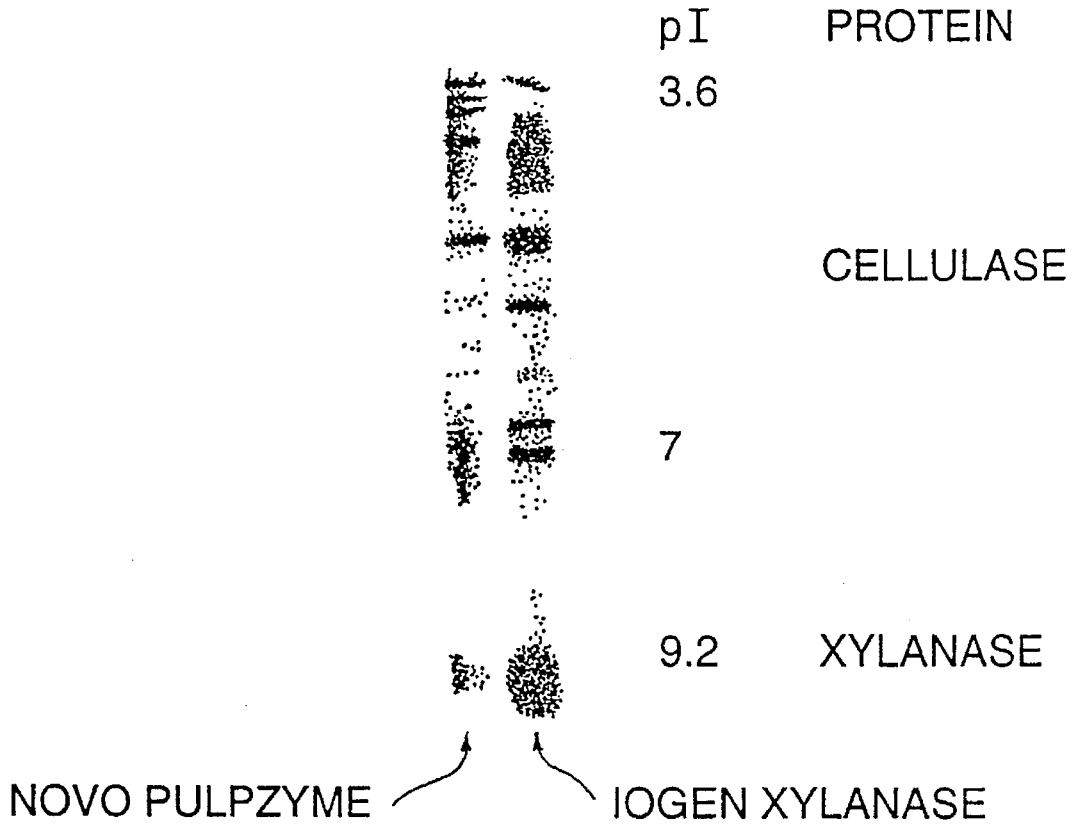
FIG. 4 compares Novo Pulpzyme™ and a xylanase preparation of Iogen Corporation on an isoelectric focusing gel.

Xylanase is identified by isoelectric focusing (IEF) gel (FIG. 4). The protein composition of the Iogen Xylanase preparation and Pulpzyme™ HA was examined by IEF, which determines the protein's isoelectric point (the pH at which the protein is at a neutral change). Xylanase focuses in a band corresponding to an isoelectric point (pI) of 9.2. Cellulase enzymes are found on the gels at positions corresponding to lower pI levels.

EXAMPLE 4

Measurement and Adjustment of pH of Pulp

The pH of unbleached Kraft brownstock taken directly from an operating Kraft mill was adjusted by the addition of sulphuric acid. Unbleached Kraft brownstock is typically a slurry of 8% to 14% solids consistency. These slurries are so thick as to make pH measurement by the usual method (i.e., direct insertion of a pH probe) prone to significant errors. To avoid these problems, the liquor was squeezed out of a sample of the pulp and the pH of this liquor measured. The pulp sample was squeezed manually, so that at least one-third of liquor in the pulp sample was separated for the pH measurement. Prior to any addition of sulphuric acid, the pH was 10.9.

Adjustment of the pH of pulp has the added difficulty of the slow mass transfer within the pulp fibers, which delays the attainment of an equilibrium pH after acids are added to the pulp. It is also important that acids be well dispersed within the pulp. The pH of the brownstock was adjusted by squeezing liquid out of the pulp, then adding acid (1% to 10% concentrate) to the liquor, and then, recombining the acidified liquor with the pulp by manually squeezing the slurry for 1 to 2 minutes. The acidified pulp is then allowed to sit undisturbed. Typical measurements of pulp pH over time after acidification are shown in Table 3. Because of the finite time for diffusion of acid into the fibers, the pH rises over time.

TABLE 3

| Time (min) | pH |
|---|---|
| 0 (Acid Added) | 5.33 |
| 18 | 6.04 |
| 30 | 6.17 |
| 60 | 6.39 |
| 90 | 6.56 |
| 120 | 6.64 |
| 150 | 6.62 |
| 180 | 6.68 |

Equilibrium pH is reached after roughly 90 minutes. In the subsequent testing, pulp was used that had been allowed to sit and have its pH equilibrate, as well as pulp that had just had acid added to it. It was found that the relevant pH for the enzyme reaction appears to be the pH at which the pulp equilibrates. This is the relevant pH for the invention, and is the pH referred to in the following examples.

EXAMPLE 5

Enhancement of Bleaching of Well-Washed Pulp by Enzyme Treatment

Unbleached softwood Kraft brownstock was obtained from a pulp mill in Eastern Canada. The pulp Kappa number was 30.2 (i.e., 4.3% lignin content) and the total soda level was 32 kg/T. A sample of pulp of 150 g (dry basis) at 8.4% solids consistency was washed with 10 L of 50° C. deionized water. The slurry was then vacuum-filtered to 25% solids consistency. The filtrate was discarded and the pulp cake was resuspended in 10 L of water and filtered a total of four times. This procedure produced "well-washed" pulp with a soda level of 0.5 Kg/T.

Aliquots of 17 g (dry basis) of well-washed pulp were suspended in deionized water to 8% solids consistency. The pH was adjusted to equilibrate at various levels between 5 and 8.7 with 0.3 to 2 ml of sulfuric acid, by the procedures described in Example 4. The pulp was placed in plastic bags and heated to 50° C. Iogen Xylanase enzyme, with activities described in Examples 1 and 2, was then added to the pulp. In this case, 12 micro-liters of the enzyme were added to each 17 g sample of pulp. The enzyme was manually mixed into the pulp for two minutes, then the pulp was undisturbed at 50° C. for 16 hours. Pulp that did not receive enzyme treatment was brought through the procedure, except enzyme was not added.

After enzyme treatment, each sample of pulp was washed with 3.6 L of ice-cold water. The pulp was then subjected to a conventional $C_DED$ bleaching sequence, which is described at length by Rudra P. Singh, The Bleaching of Pulp, TAPPI Press, Chapters 3, 4, and 6. Chlorination was carried out at 2.5% consistency, 40° C. for 1 hour. The active chlorine usage was 6% on pulp, of which 90% of this was chlorine and 10% chlorine dioxide. The extraction stage was carried out at 10% consistency, 80° C. for 1 hour. The caustic charge was 3.6% on pulp. The chlorine dioxide stage was carried out at 10% consistency, 80° C. for 2 hours. The chlorine dioxide usage was 0.8% on pulp. The pulp was washed thoroughly between stages. The bleached pulp was formed into handsheets and the brightness measured by an Elrepho instrument calibrated to an ISO scale. In the absence of enzyme treatment, the bleached pulp was 71 ISO brightness.

Figure 1:
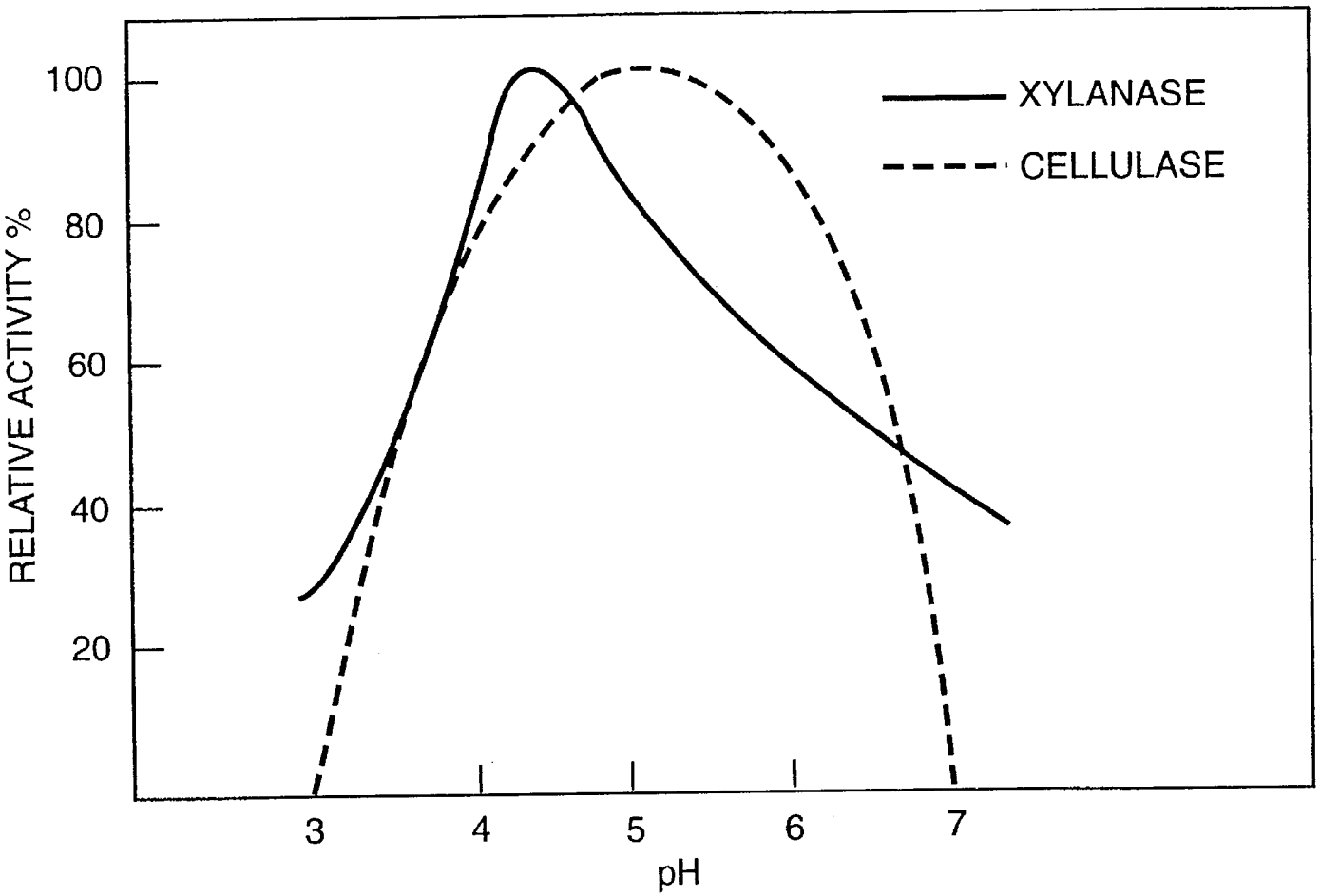
FIG. 1 is a graphical representation of the prior art showing the percent relative activity of xylanase and cellulase as a function of pH.
Figure 2:
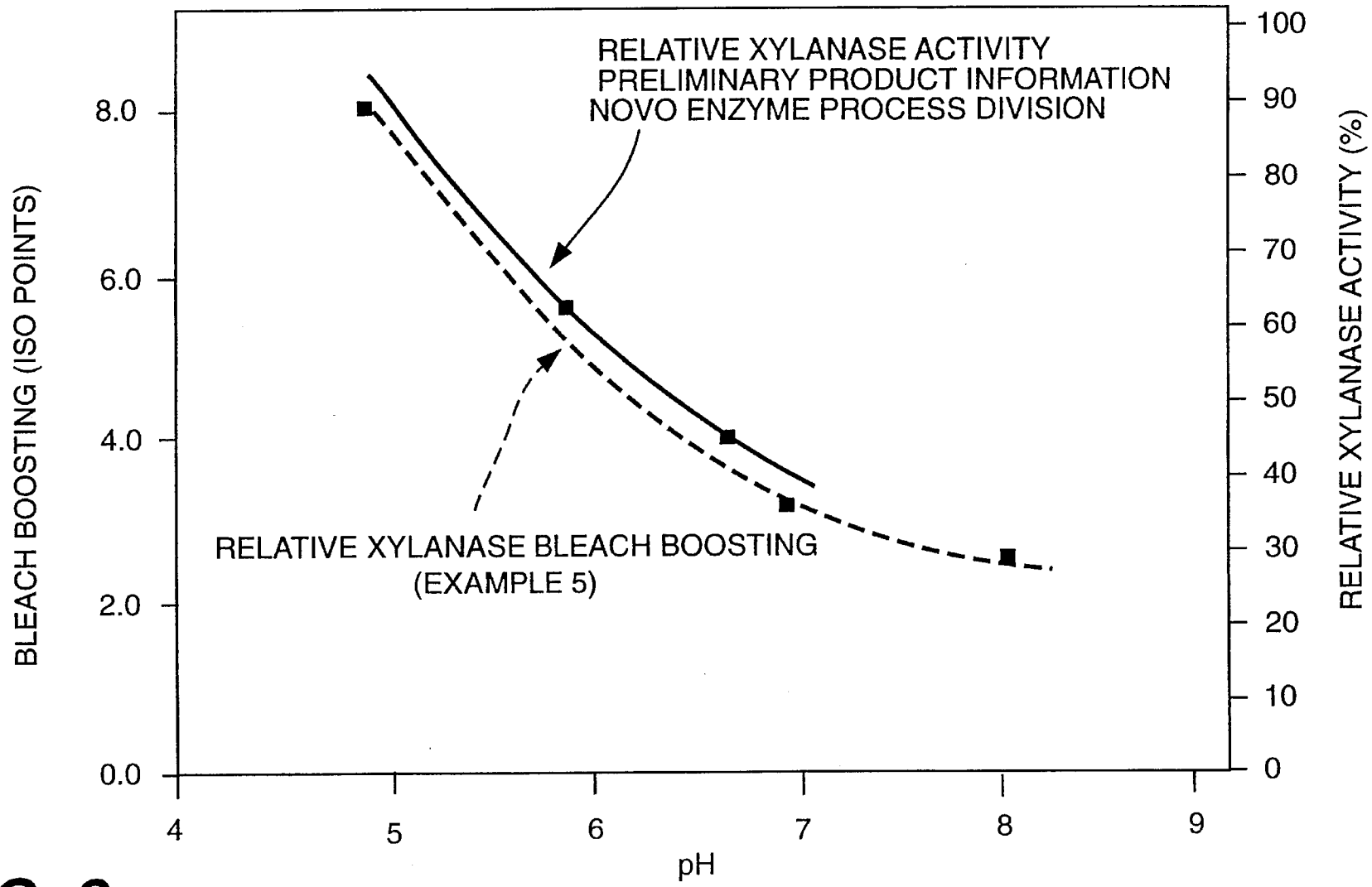
FIG. 2 represents data from Example 4 and compares the activity profile taught by Novo with the brightness boosting performance of a *Trichoderma xylanase.*

The degree of enhanced brightness due to enzyme treatment relative to an untreated control sample is shown in FIG. 2 and Table 4. As expected, the largest benefit of enzyme treatment occurred at pH 5 (8 ISO points), and the bleaching benefit decreased as the pH increased. FIG. 2 shows the expected agreement between the xylanase bleaching performance and the Novo Pulpzyme™ literature on xylanase hydrolytic activity as a function of pH.

TABLE 4

| pH (Equilibrated) | Bleach Boosting (ISO Points) |
|---|---|
| 5.0 | 8.0 |
| 6.0 | 5.6 |
| 6.8 | 4.0 |
| 7.1 | 3.2 |
| 8.2 | 2.6 |

EXAMPLE 6

Deleterious Effect of Black Liquor on Enzyme Treatment

Unbleached Kraft brownstock, described in Example 5, was treated with the Iogen Xylanase preparation (described in Example 2) as received from the mill. The procedures were as described in Example 5, except the initial multistage water washing was omitted. The pulp was adjusted to equilibrate at pH 5 with 6 ml of 1N sulfuric acid. The enzyme treatment and $C_DED$ bleaching were carried out as in Example 5.

The results are shown in Table 5. The enzyme boosted the brightness of the bleached pulp by 3 ISO points, as compared to 8 ISO points with pH 5 enzyme treatment on well-washed pulp. This result is not surprising, because black liquor contains many aromatic and sulfide compounds that would be expected to be detrimental to enzyme activity.

TABLE 5

| Pulp Treated at pH 5 | Bleach Boosting (ISO Points) |
|---|---|
| Well Washed (Example 5) | 8 |
| Black Liquor present | 3 |

EXAMPLE 7

Beneficial Effect of Black Liquor on Enzyme Treatment of Pulp

The procedures of Example 6 were carried out, except several samples of brownstock were adjusted to equilibrate at pH 5 to 8.2 with sulfuric acid before enzyme treatment. The subsequent enzyme treatments and bleaching were carried out as described in Example 6.

Figure 5:
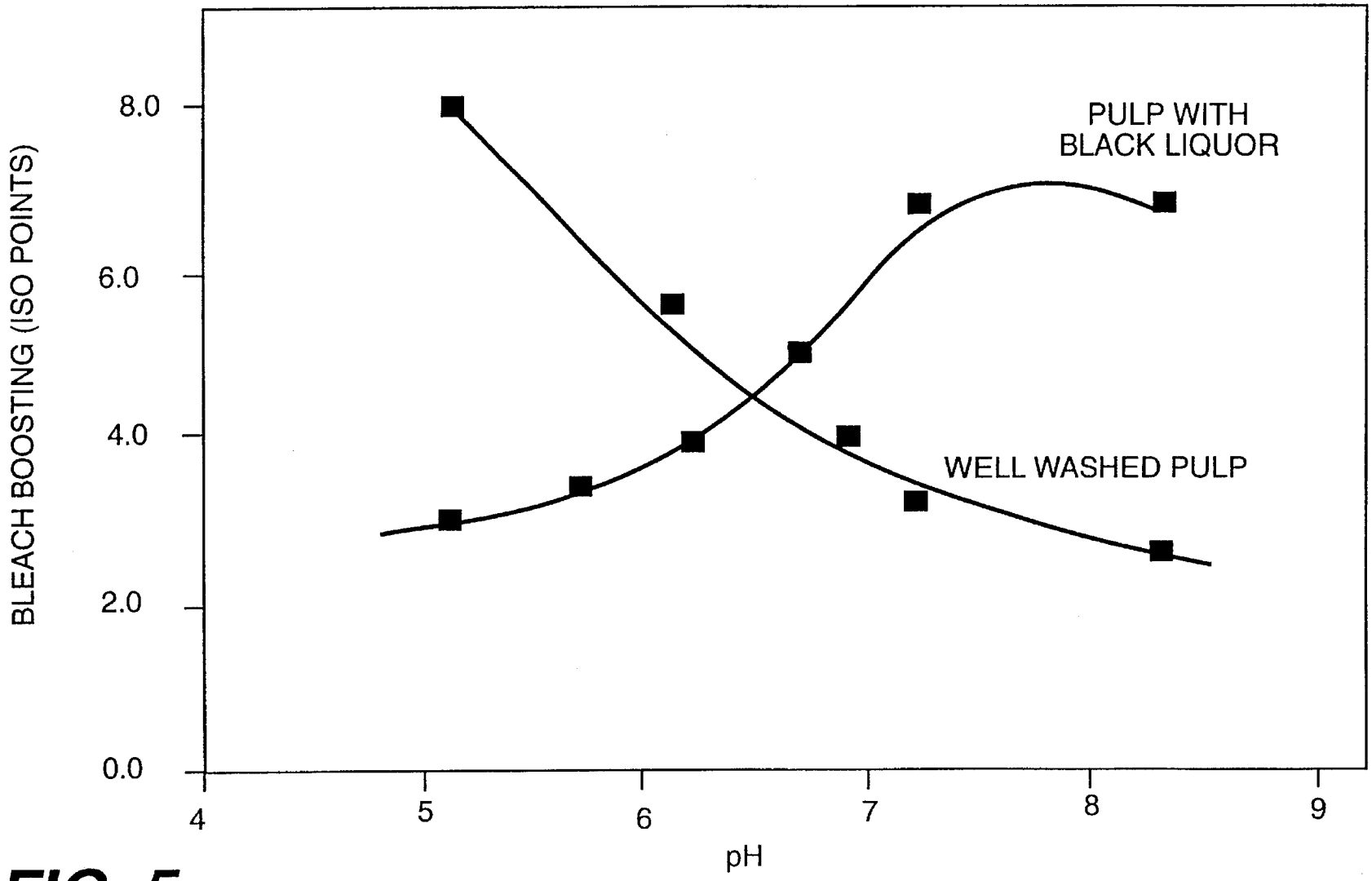
FIG. 5 shows the results obtained in Example 7, in which bleach boosting activity in pulp containing black liquor and well washed pulp in a pH range of from 5.0–8.0 is compared.

The results are shown in FIG. 5 and Table 6. Surprisingly, the benefit of enzyme treatment increases as the pH is increased. Above roughly pH 6.4, the enzyme is more effective on pulp that contains some black liquor than on well washed pulp. That is, as the equilibrated pH values increased for pulp containing black liquor, the bleach boosting increased, whereas, for well-washed pulp, the bleach boosting decreased correspondingly when the pH was increased to basic.

TABLE 6

ENZYME TREATMENT OF PULP WITH BLACK LIQUOR AND WELL-WASHED PULP

| | Bleach Boosting (ISO Points) | |
|---|---|---|
| pH | Pulp with Black Liquor | Well-Washed Pulp (as extrapolated from FIG. 5) |
| 5.0 | 3.0 | 8 |
| 5.6 | 3.4 | 6.5 |
| 6.1 | 3.9 | 5.3 |
| 6.6 | 5.0 | 4.3 |
| 7.1 | 6.8 | 3.2 |
| 8.2 | 6.8 | 2.5 |

EXAMPLE 8

Beneficial Effect of Black Liquor on Enzyme Treatment of Pulp

The procedures of Example 7 were carried out, except the pulp was treated with enzyme immediately after the addition of the sulfuric acid. The amounts of sulfuric acid added were sufficient to bring the steady state equilibrium pH to between 5.8 and 7.9. The subsequent bleaching was carried out as described in Example 5.

The results are shown in Table 7. The pH of the pulp increased about 1 unit in two hours after addition of the acid, then maintains a steady value. The bleaching boost as a function of this equilibrated pH is similar to that obtained in Example 7 when the pulp was equilibrated before enzyme treatment. This shows that the equilibrated pH characterizes the enzyme's effects.

TABLE 7

| pH | | |
|---|---|---|
| Initial (at enzyme addition) | After 2 hrs. | Bleach Boosting (ISO Points) |
| 4.7 | 5.8 | 4.0 |
| 5.1 | 6.2 | 4.1 |
| 5.9 | 6.6 | 4.8 |
| 6.4 | 7.2 | 6.4 |
| 6.6 | 7.5 | 6.6 |
| 6.8 | 7.9 | 6.5 |

While the invention has been described in connection with specific embodiments thereof, it will be understood that it is capable of further modification and that this application is intended to cover any variation, uses or adaptations of the invention following, in general, the principles of the invention and including such departures from the present disclosure as come within known or customary practice in the art to which the invention pertains and as may be applied to the essential features hereinbefore set forth and as fall within the scope of the invention.

What is claimed is:

1. A method to improve the bleachability of wood pulp obtained by standard pulping processes that produce incompletely washed brownstock of more than 1 Kg soda per ton of pulp, comprising treating said brownstock at a pH range of approximately 7.0 to 9.0 with a hemicellulase enzyme preparation having both a pH optimum for hemicellulase activity below 6.0, as measured by activity against a purified xylan substrate, and a low cellulase activity, as measured by the IEA standard filter paper assay, such that the total amount of cellulase added to the brownstock is not more than about 10,000 FPU per ton of pulp, wherein said hemicellulase enzyme preparation consists essentially of a xylanase produced from a Trichoderma microorganism, and whereby said brownstock will exhibit increased bleachability as compared to said brownstock being treated with said hemicellulase enzyme at said pH optimum.

2. The method of claim 1 wherein the enzyme preparation has a low cellulase content such that not more than about 2,000 FPU are added per ton of pulp.

3. The method of claim 2 wherein the enzyme preparation has a low cellulase content such that about 500 FPU or less are added per ton of pulp.

4. A method of making a paper comprising selecting the wood pulp produced by the method of claim 1 and using said pulp to produce the paper.

5. A method for treating wood pulp comprising the steps of:

(a) delignifying wood in a pulping liquor to produce a fiber slurry of pulp that has a residual soda content of more than 1 Kg per ton of pulp, wherein said pulp is incompletely washed;

(b) adding acid or base to the fiber slurry pulp to stabilize the pH between 7.0 and 9.0;

(c) treating the pulp with a hemicellulase enzyme preparation having both a pH optimum for hemicellulase activity below 6.0, as measured by activity against a purified xylan substrate, and a low cellulase activity, as measured by the IEA standard filter paper assay, such that the total amount of cellulase added to the brownstock is not more than about 10,000 FPU per ton of pulp, wherein said hemicellulase enzyme preparation consists essentially of a Xylanase produced by a Trichoderma microorganism, and whereby said brownstock will exhibit increased bleachability as compared to said brownstock being treated with said hemicellulase enzyme at said pH optimum;

(d) incubating the pulp and enzyme mixture for a period of at least 15 minutes; and (e) bleaching the pulp.

6. The method of claim 5 wherein step (a) comprises cooking wood chips in a pulping liquor to produce a fiber slurry.

7. The method of claim 6 wherein the cooking process is followed by an oxygen delignification process.

8. The method of claim 5 wherein the delignifying step is according to the Kraft process.

9. The method of claim 5 wherein the enzyme preparation has a low cellulase content such that not more than about 2,000 FPU are added per ton of pulp.

10. The method of claim 9 wherein the enzyme preparation has a low cellulase content such that about 500 FPU or less are added per ton of pulp.

11. The method of claim 5 wherein the pH of the fiber slurry pulp is stabilized at between approximately 7.0 and 8.5.

12. The method of claim 5 wherein weak black liquor is mixed with the acid or base and added to the delignified wood in step (b).

13. The method of claim 12 wherein (b) and the addition of the enzyme are conducted substantially simultaneously.

14. The method of claim 5 wherein said pulp is bleached with a bleaching agent selected from the group consisting of chlorine, chlorine dioxide, hypochlorite, ozone, oxygen, hydrogen peroxide, hydrosulphite and sodium sulphite.

15. A method of making a paper comprising selecting the wood pulp produced by the method of claim 5 and using said pulp to produce the paper.

* * * * *

UNITED STATES PATENT AND TRADEMARK OFFICE

CERTIFICATE OF CORRECTION

PATENT NO. : 5,591,304

DATED : January 7, 1997

INVENTOR(S) : Jeffrey TOLAN, et al.

It is certified that error appears in the above-indentified patent and that said Letters Patent is hereby corrected as shown below:

On the title page, item

[73] ASSIGNEE:

"Von Kreisler Selting Werner, Cologne, Germany" should read --Iogen Corporation, Ottawa, Canada--

Signed and Sealed this

Twenty-ninth Day of April, 1997

Bruce Lehman

*Attest:*

BRUCE LEHMAN

*Attesting Officer*

*Commissioner of Patents and Trademarks*